US011638866B2

(12) United States Patent
Dowling et al.

(10) Patent No.: US 11,638,866 B2
(45) Date of Patent: May 2, 2023

(54) GAME TABLE

(71) Applicant: SKEECH GAMES LLC, Fort Collins, CO (US)

(72) Inventors: Joshua Dowling, Fort Collins, CO (US); Zachary Dowling, Timnath, CO (US)

(73) Assignee: SKEECH Games, LLC, Fort Collins, CO (US)

( * ) Notice: Subject to any disclaimer, the term of this patent is extended or adjusted under 35 U.S.C. 154(b) by 3 days.

(21) Appl. No.: 16/849,253

(22) Filed: Apr. 15, 2020

(65) Prior Publication Data

US 2020/0324191 A1 Oct. 15, 2020

Related U.S. Application Data

(60) Provisional application No. 62/920,087, filed on Apr. 15, 2019.

(51) Int. Cl.

| | |
|---|---|
| ***A63F 7/00*** | (2006.01) |
| ***A63F 7/34*** | (2006.01) |
| ***A63F 7/30*** | (2006.01) |

(52) U.S. Cl.

CPC ..... *A63F 7/0017* (2013.01); *A63F 7/30* (2013.01); *A63F 7/34* (2013.01); *A63F 2007/346* (2013.01)

(58) Field of Classification Search

CPC .. A63F 7/0017; A63F 7/34; A63F 7/30; A63F 2007/346; A63F 7/0005; A63B 67/02; A63D 15/003; A63D 15/02; A63D 15/00

USPC ..... 273/123 R, 127 C, 127 B, 118 R, 142 R, 273/125; 473/115–117, 17–20, 28; D21/303, 341, 342, 345, 346, 321

See application file for complete search history.

(56) References Cited

U.S. PATENT DOCUMENTS

| | | | | |
|---|---|---|---|---|
| 202,071 A * | 4/1878 | Strange | A63F 7/0017 273/119 R |
| 607,020 A * | 7/1898 | Dodge | A63B 63/00 273/123 R |
| D34,806 S * | 7/1901 | Wilbraham | D21/341 |

(Continued)

FOREIGN PATENT DOCUMENTS

| | | |
|---|---|---|
| EP | 0364882 B1 | 4/1994 |
| JP | 2014180527 A | 9/2014 |

OTHER PUBLICATIONS

Skee Roll, retrieved from internet at <http://www.allisonsfuninc.com/inventory/m.directory/78/view/646> on Apr. 15, 2020 1 page.

(Continued)

*Primary Examiner* — Sebastiano Passaniti

(74) *Attorney, Agent, or Firm* — Cochran Freund & Young LLC; William W. Cochran

(57) ABSTRACT

A game table is provided with a generally flat playing surface having opposed playing ends position spaced apart in a length dimension to allow players to participate from each of the playing ends. The playing surface has a length dimension greater than a width dimension of the playing surface. A plurality of holes is formed with a V-shaped pattern oriented in the length dimension. The V-shaped pattern is positioned adjacent each of the playing ends. The V-shaped pattern has a plurality of holes that increase in diameter away from the end hole. A gutter surrounds the playing surface.

15 Claims, 5 Drawing Sheets

(56) References Cited

U.S. PATENT DOCUMENTS 952,644 A 3/1910 Sato
1,086,959 A * 2/1914 Vinton ..... A63F 7/0005 273/123 R
1,154,529 A * 9/1915 Meluzzi ..... A63F 7/0005 273/126 R
1,234,618 A * 7/1917 Brenner ..... A63F 7/0005 273/123 R
1,259,888 A * 3/1918 MacCormack ..... A63F 7/0005 273/123 R
1,295,236 A * 2/1919 Thomas ..... A63F 7/0005 235/1 B
1,314,843 A 9/1919 West
1,385,677 A * 7/1921 Gillette ..... A63F 7/0005 273/119 R
1,409,527 A * 3/1922 Debelack ..... A63F 7/0023 473/19
1,589,904 A 6/1926 Schilke
1,714,905 A 5/1929 Dieterich
2,005,660 A 6/1935 Maxwell
2,247,769 A * 7/1941 Constant ..... A63D 1/00 473/116
D142,122 S * 8/1945 Rolley ..... D21/341
2,409,373 A * 10/1946 Mautner ..... A63B 59/80 273/113
2,529,535 A * 11/1950 Bertelsmeyer ..... A63F 7/0017 340/323 R
2,719,717 A * 10/1955 Verity ..... A63F 1/06 273/126 R
2,724,594 A * 11/1955 Anderson ..... A63F 7/0005 273/352
2,850,283 A * 9/1958 Lemelson ..... A63F 7/066 273/397
3,386,737 A 6/1968 Burgess
3,450,406 A * 6/1969 Brown ..... A63D 5/00 473/83
3,764,139 A * 10/1973 Cohen ..... A63F 7/0608 273/125 R
3,992,009 A * 11/1976 Trbovich ..... A63F 7/3603 273/126 R
4,146,228 A * 3/1979 Laciste ..... A63D 15/00 273/126 R
4,261,577 A * 4/1981 Ellis ..... A63F 7/249 124/7
4,316,613 A * 2/1982 Harris ..... A63F 7/02 273/401
4,348,026 A * 9/1982 Kauffmann ..... A63F 7/0017 273/126 R
4,995,611 A 2/1991 Goldthorpe
5,209,493 A * 5/1993 Chernek ..... A63B 67/06 273/400
7,325,807 B1 * 2/2008 Eason ..... A63F 7/0005 273/342
8,205,887 B2 * 6/2012 Wyland ..... A63B 67/002 273/342
8,439,359 B2 * 5/2013 Stites ..... A63F 7/0005 273/126 R
9,044,665 B2 * 6/2015 Haase ..... A63D 15/04
9,782,666 B2 * 10/2017 Dahl ..... A63F 7/0017
10,307,664 B1 * 6/2019 Villela ..... A63F 9/0402
2005/0006841 A1 * 1/2005 Schromm ..... A63F 7/0668 273/108.4
2005/0104284 A1 * 5/2005 Pollu ..... A63B 67/002 273/123 R
2006/0226606 A1 * 10/2006 Finley ..... A63B 67/002 273/342
2009/0033031 A1 * 2/2009 Lany ..... A63F 7/0005 273/126 R
2009/0085298 A1 * 4/2009 Terich ..... A63F 7/02 273/401
2011/0256945 A1 * 10/2011 Hsiang ..... A63B 71/0669 473/197
2012/0038109 A1 * 2/2012 Battista ..... A63F 9/0204 273/402
2015/0165308 A1 6/2015 Huang
2018/0207503 A1 * 7/2018 Rivard ..... A63B 63/00
2019/0143200 A1 * 5/2019 Villela ..... A63F 3/00003 273/146
2019/0184254 A1 * 6/2019 Hamilton ..... A63B 67/02

OTHER PUBLICATIONS

Bank Shot, retrieved from internet at <https://www.pinterest.com/pin/280982464228140204/> on Apr. 15, 2020, 1 page.
Rollaball, retrieved from internet at <https://data dlf.org.uk/product.php?product_id=0030795&groupid=1678> on Apr. 15, 2020, 1 page.

* cited by examiner

GAME TABLE

CROSS-REFERENCE TO RELATED APPLICATIONS

This application claims the benefit of U.S. provisional application Ser. No. 62/920,087 filed Apr. 15, 2019, the disclosure of which is hereby incorporated in its entirety by reference herein.

TECHNICAL FIELD

The present application relates to a game using balls rolled on a game table.

SUMMARY

According to one embodiment, a game table is provided with a generally flat playing surface having opposed playing ends position spaced apart in a length dimension to allow players to participate from each of the playing ends. The playing surface has a length dimension greater than a width dimension of the playing surface. A plurality of holes is formed with a V-shaped pattern oriented in the length dimension. The V-shaped pattern is positioned adjacent each of the playing ends. The V-shaped pattern has a plurality of holes that increase in diameter away from the end hole. A gutter surrounds the playing surface.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
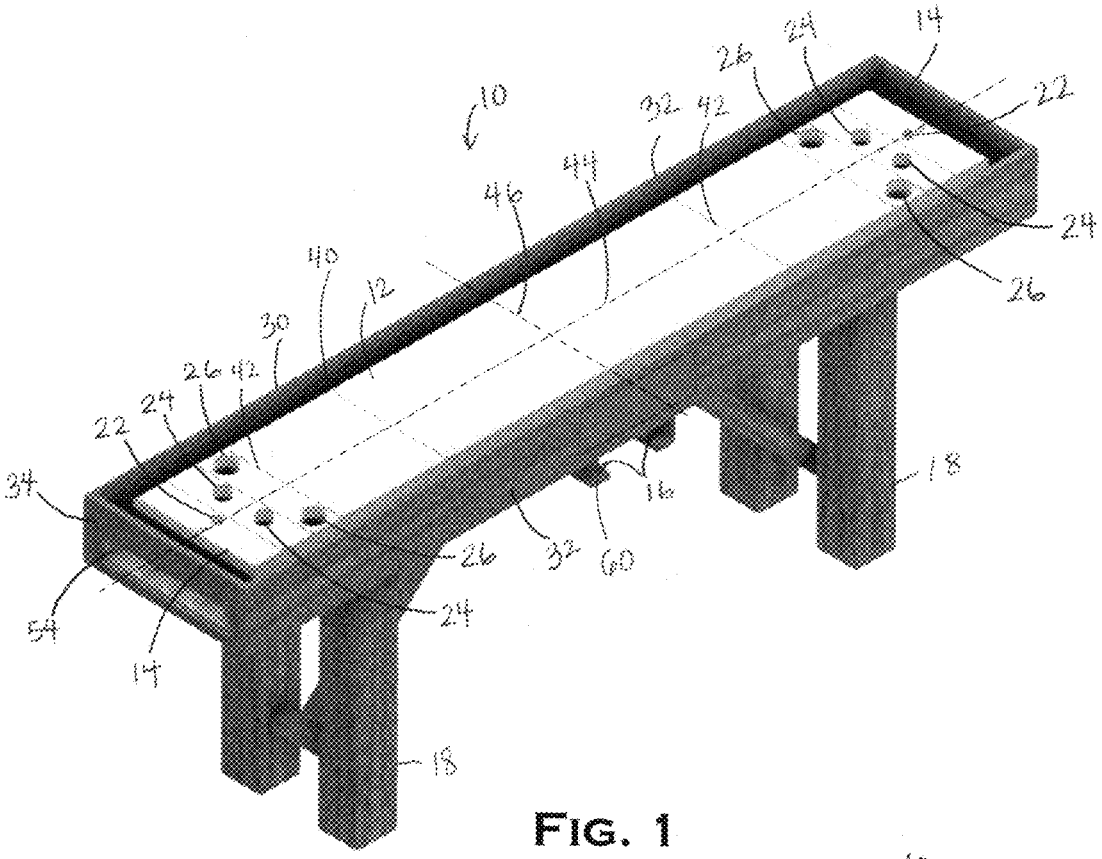
FIG. 1 is a front-side perspective view of a game table according to one embodiment.
Figure 2:
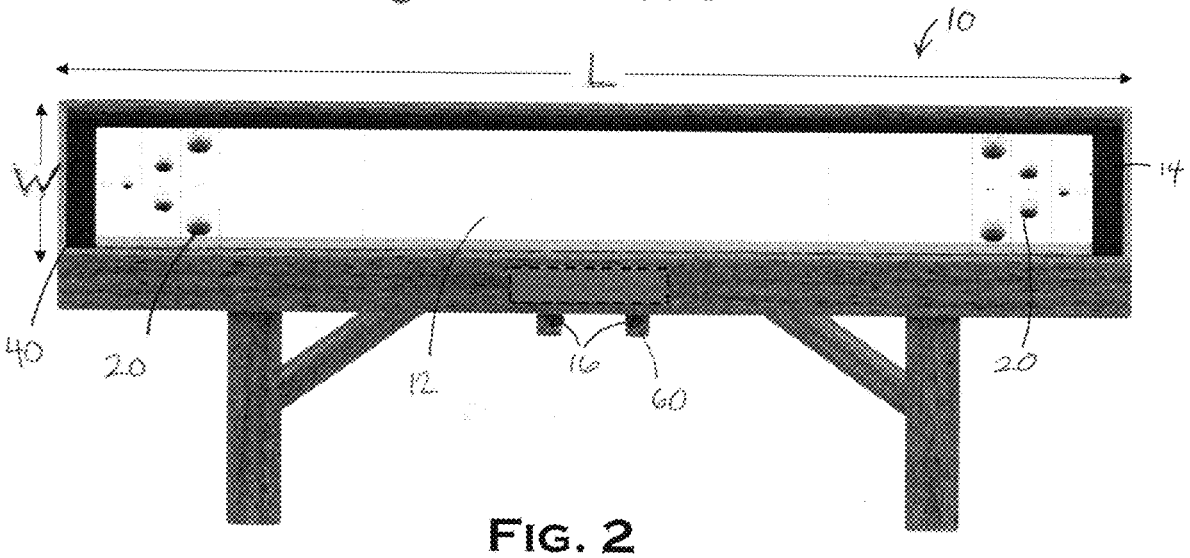
FIG. 2 is a front perspective view of the game table FIG. 1.
Figure 3:
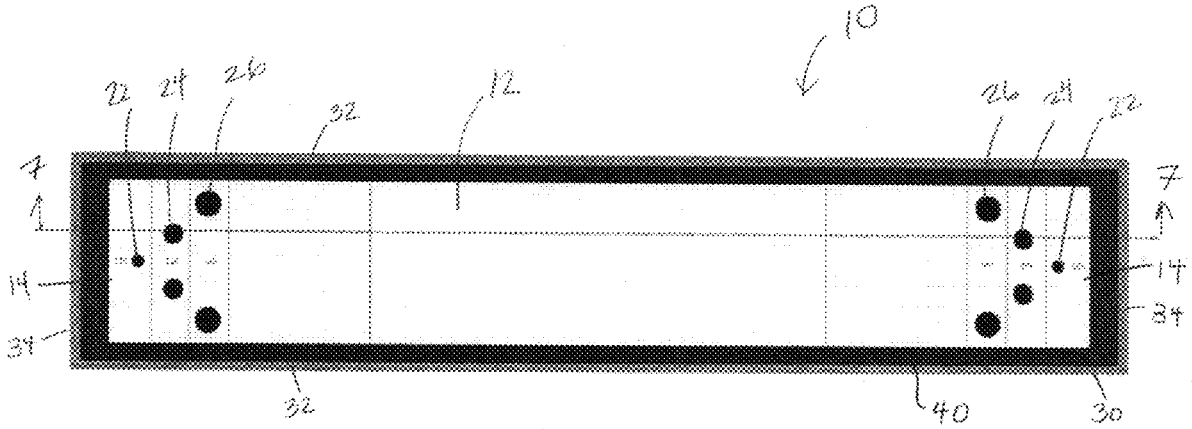
FIG. 3 is a top view of the game table of FIG. 1.
Figure 4:
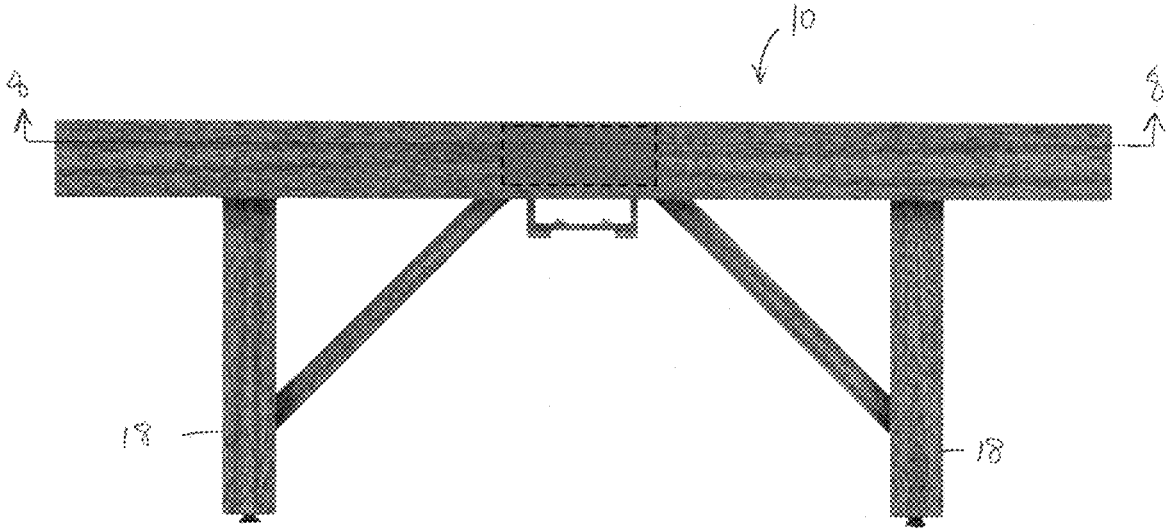
FIG. 4 is a front view of the game table of FIG. 1, where the back view is identical to the front view.
Figure 5:
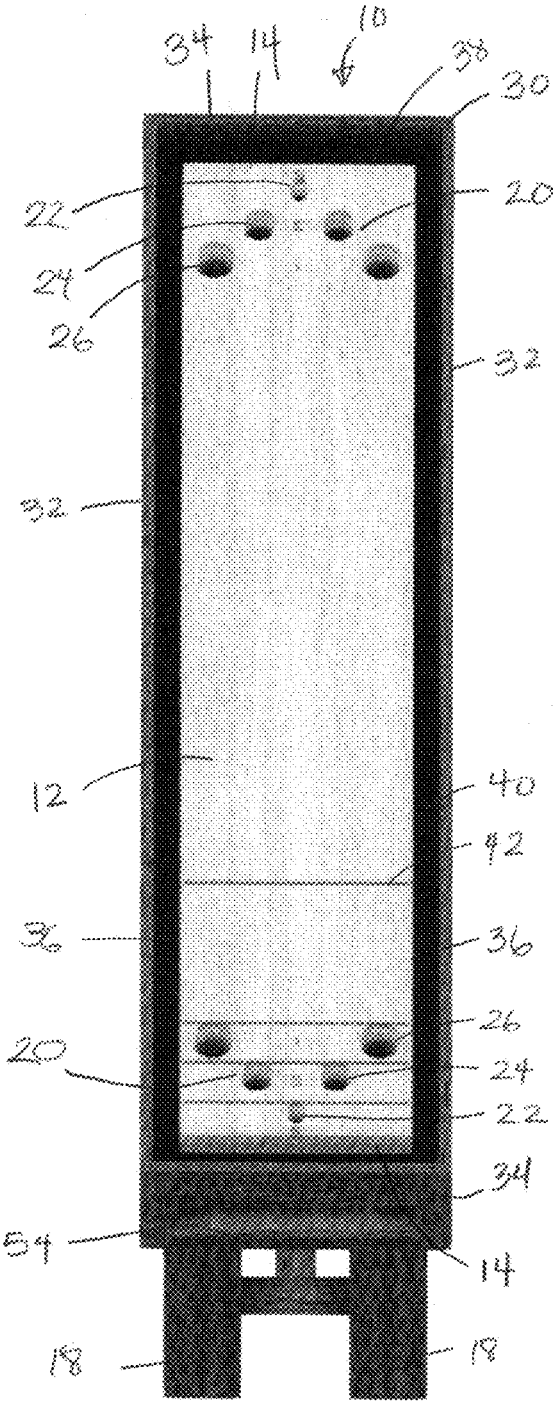
FIG. 5 is a right-side perspective view of the game table of FIG. 1.
Figure 6:
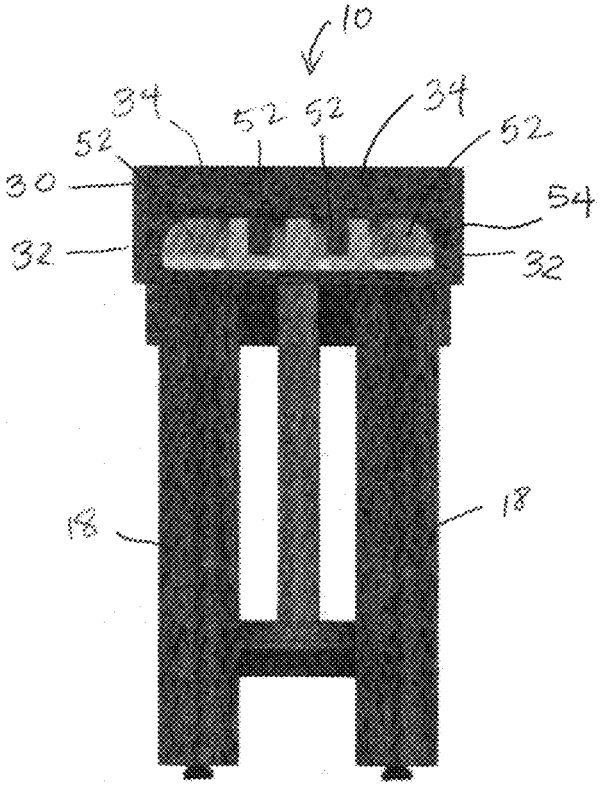
FIG. 6 is a right-side view of the game table of FIG. 1, where the left-side view is identical to the right-side view.
Figure 7:
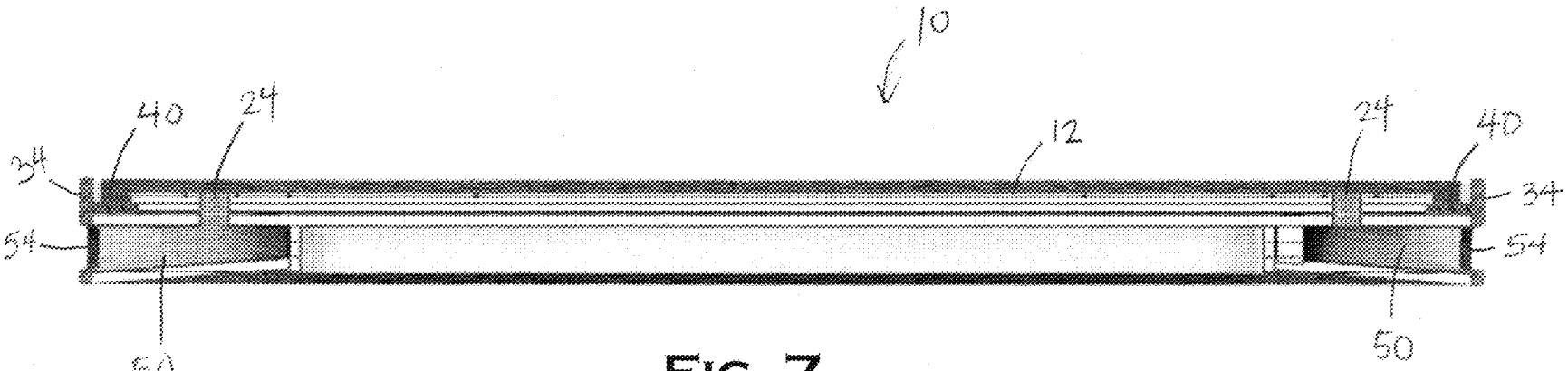
FIG. 7 is a front section view through line 7-7 of FIG. 3.
Figure 8:
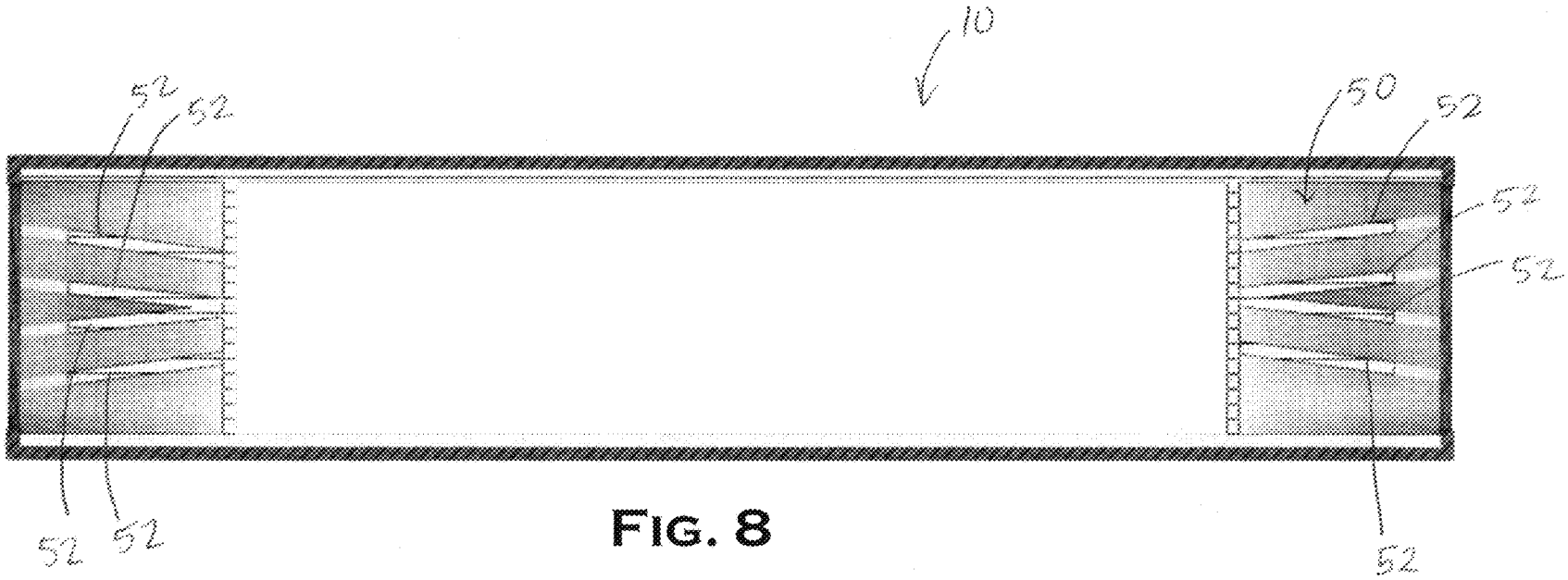
FIG. 8 is a top section view through line 8-8 of FIG. 4.

FIG. 1 illustrates a game table 10 with a flat playing surface 12 having two playing ends 14. Each player/team rolls balls 16 from each playing end 14 of the table to score points. Points are scored by making a ball 16 in a hole in the hole pattern 20. Each hole in the hole pattern 20 has a different point value. The large outer holes 26 are assigned one point, the intermediate holes 24 are assigned three points and the small-end hole 26 is assigned five points. The game is played to twenty-one points. The holes may be assigned other point values and different games and scoring values may be used.

The game starts with each player/team rolling balls, one at a time from one playing end 14 toward the hole pattern 20 at the opposite playing end. The game table 10 may include eight balls, four for each player/team, however any suitable number of balls is possible. Players/teams alternate rolling their balls after each player's turn. In one variation of the game, the object of the game is to score exactly twenty-one points by a combination of the holes 22, 24, 26. If a player's/team's score goes over twenty-one points at any time during their turn, that player's/team's score then goes back to fifteen points and they finish out their turn. When a player/team rolls exactly twenty-one points the game is not over yet and at this time, any remaining balls are rolled back to the opposing player/team. The opposing player/team always gets a chance to tie the game at twenty-one points with one final turn using all four balls. If the opposing player/team is not able to tie twenty-one points on this final turn, the game is over and the first player/team that scored twenty-one points wins. If the opposing player/team is able to tie twenty-one points on this final turn, then the game goes to sudden death. Sudden death is played by each player/team getting one final turn with all four balls and the high score wins the game.

The game table 10 of the present application allows players/teams to participate from each playing end 14. A two person game (one-on-one) or a four person game (two-on-two, or team play), where players/teams stand at opposite playing ends 14 of the game table 10 to play the chosen game. Unlike many one-ended games, such as bowling, skeeball, or arcade game, the game table 10 allows play from each of the playing ends 14. The game table 10 is a head-to-head game played by alternating the roll of balls 16 per player, per turn. When playing one-on-one, only four balls are required, and when playing teams, eight balls may be used. Some examples of play using the game table 10 include: 'One ball', 'Two ball,' or 'Four ball.' One ball is played by each player rolling four balls one at a time per turn (total of four rolls). Two ball is played by each player rolling two balls at a time per turn (total of two rolls). Four ball is played by each player rolling all four balls at one time per turn (total of one roll). Other games or numbers of balls may be used with the game table 10.

In one embodiment, the game table 10 and playing surface 12 are formed of wood. Wood offers a different grain and allows for variation in how the balls 16 roll on each individual game table. This gives every single table is own uniqueness and makes playing more fun because the players have to learn how each table rolls. Wood also looks aesthetically pleasing. The game table 10 may be built of wood and the necessary hardware or adhesives to assembly the table such as steel/metal screws wood glue, and other suitable fasteners. Other materials may be used to construct the game table, including but not limited to plastic, metal, aluminum, vinyl, or rubber. As shown, the game table 10 is supported by four legs 18 and cross-supports. However, the game table 10 may also be placed on any support surface such as a table.

As shown in FIGS. 1-6, the game table 10 is designed using a shadow box 30 making up the outside walls of the game table 10. The shadow box 30 has side walls 32 extending in a length direction L and end walls 34 adjacent the playing ends 14 and extending in a width direction W. The playing surface 12 is offset within the shadow box walls 32, 34. In the illustrated embodiment, the shadow box 30 has length of approximately 94-98 inches and a width of 10-20 inches. The shadow box walls 32, 34 have a height of 7-8 inches. In other embodiments, the shadow box has a length of 6-12 feet. The shadow box 30 may also have a length of 1-5 feet. However, other sizes and dimensions of the shadow box 30 are contemplated.

The playing surface 12 for the game table 10 is generally flat and planar. The playing surface 12 may be formed of a sheet of wood. In the illustrated embodiment, the playing surface 12 has a length of approximately 87-91 inches and a width of 15 inches. In other embodiments, the playing surface 12 may range in size from 1-12 feet in length. In another embodiment, the length of the playing surface 12 is at least five times the width. In further embodiments the length dimension of the playing surface is in the range of 2.5 to six times the width dimension. However, other sizes and dimensions of the playing surface 12 are contemplated. Further, the playing surface 12 may have different shapes. For example, the playing surface 12 may be oval, circular, rectangular, or square. The playing surface 12 may have an aspect ratio where the length is greater than the width, but the region along the playing end 14 may be semi-circular, parabolic or triangular for example.

The game table 10 has pair of hole patterns 20 defined adjacent each playing end 14. As shown in the Figures, each hole pattern 20 is V-shaped. The V-shaped hole pattern 20 is oriented in the length dimension to be symmetric about a longitudinal centerline 44 of the playing surface 12. The hole patterns 20 are spaced apart in the length dimension and are mirror images of each other about a midline 46 between the two opposing ends 11.

Figure 9:
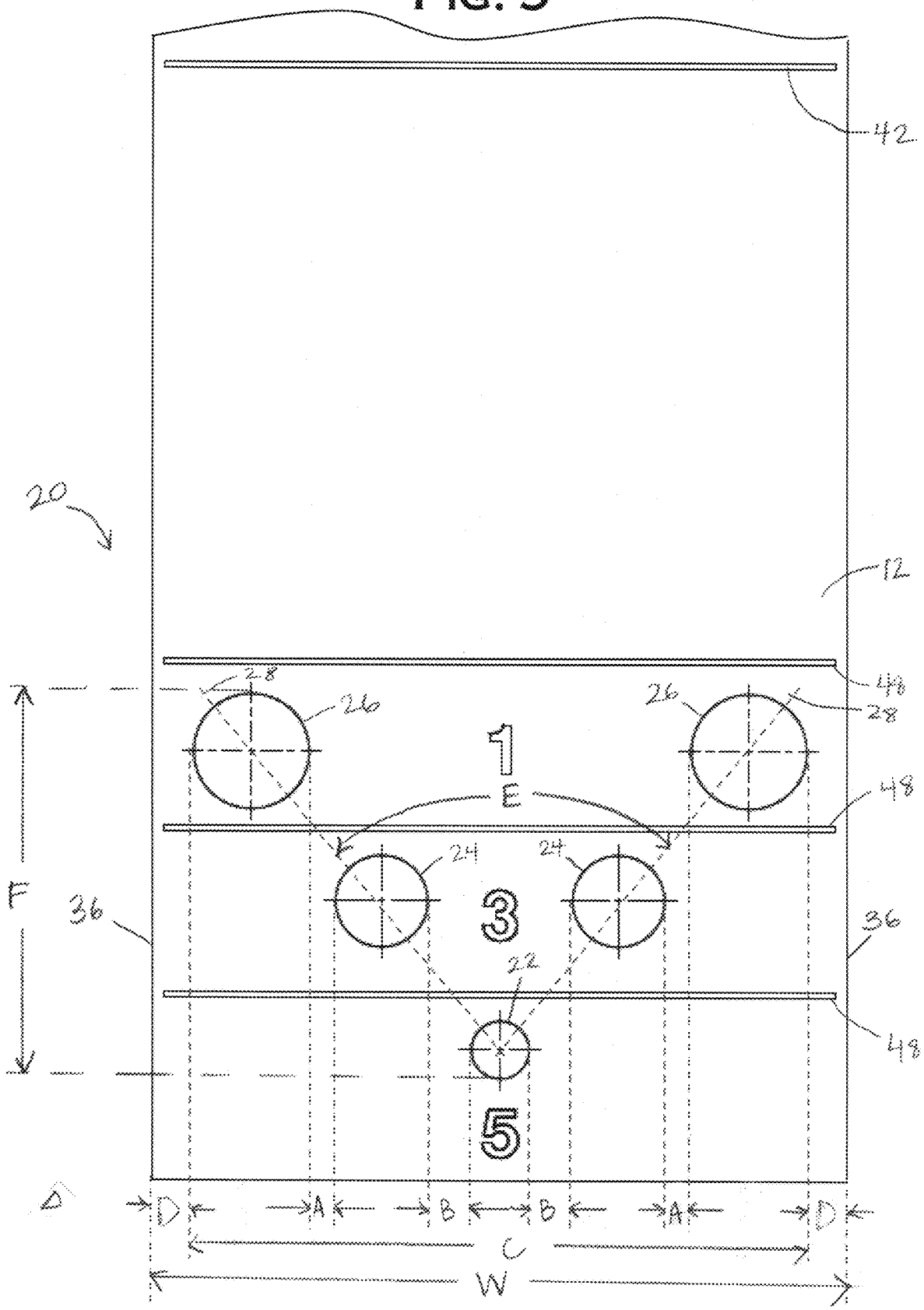
FIG. 9 is a detailed view of the playing end and the hole pattern.

FIG. 9 illustrates the playing surface 12 and one playing end 14 in more detail. Each hole pattern 20 is formed of two rows 28 of holes intersecting at the end hole 22. The holes 22, 24, 26 decrease in size towards the point of the V-shaped pattern. As the holes decrease in size the point value increases. In the illustrated embodiment, the two outer holes 26 have a diameter of approximately 2.5 inches and are worth one point. The outer holes 26 are the largest holes and closes to the midline 46. The outer holes 26 may have a diameter larger than the ball 16 provides the most clearance to the ball 16. The two intermediate holes 24 measure approximately 2 inches in diameter and are worth 3-points holes. The intermediate holes 24 are larger than the balls 16 and smaller than the outer holes 26. The small-end hole 22 is worth 5-points and measures 1.25 inches in diameter and positioned closest to each playing end 14 of the game table 10. The center end hole 22 is the smallest hole and is centered on the playing surface 12 in the width direction W. The dimensions of the holes 22, 24, 26 may change based on the overall dimensions of the playing surface 12 or the size of the ball 16.

The game table 10 includes balls 16 that may be steel ball bearings. In the illustrated embodiment, the steel ball bearings may be standard size such as 1.0625 inch diameter. The size of the ball 16 may vary based on the size of the holes 22, 24, 26. In another embodiment, the balls 16 may be steel ball bearings with a diameter of 16 millimeters to 0.75 inches. The balls 16 used with the game table 10 can be any suitable material wood, plastic, rubber, or steel. In the illustrated embodiment, the smallest center hole 22 has a diameter approximately 19% greater than the diameter of the ball 16. In another embodiment, the smallest center hole 22 has a diameter approximately 15-30% greater than the diameter of the ball 16. greater than the diameter of the ball 16. In the illustrated embodiment, the intermediate hole 24 has a diameter approximately 94% greater than the diameter of the ball 16. In another embodiment, the intermediate hole 24 has a diameter approximately 80-120% than the diameter of the ball. In the illustrated embodiment, the largest outer hole 26 has a diameter approximately 144% greater than the diameter of the ball 16. In another embodiment, the largest outer hole 26 has a diameter approximately 125-175% greater than the diameter of the ball 16. In a further embodiment, the smallest center hole 22 has a diameter up to 150% greater than the diameter of the ball, the intermediate hole 24 has a diameter up to 300% greater than the diameter of the ball 16, and the outer hole 26 has a diameter up to 500% greater than the diameter of the ball 16.

The holes in the hole pattern 20 are sized and positioned to allow a fun, yet challenging game between two players or teams of players. The holes 22, 24, 26 are spaced apart so that every roll does not result in the ball 16 going in one of the holes, but it is not impossible or too difficult to roll the balls 16 in the holes. The players must learn skill and accuracy to roll the balls in one of the holes 22, 24, 26. For example, each of the holes 22, 24, 26 are spaced apart in the width direction W by a hole-spacing distance that is less than a diameter size of the ball 16. For example, the outer holes 26 are spaced apart from the intermediate holes 24 by a first hole-spacing distance A. Similarly, the intermediate holes 24 are spaced apart from the center-end hole 22 by a second hole-spacing distance B. The second hole-spacing distance B is greater than the first hole-spacing distance A, which makes it more challenging to roll the ball in the center-end hole 22. In the illustrated example, the first hole spacing distance A is approximately 0.625 inches and the second hole spacing distance B is approximately 0.875 inches. Depending on the speed and how a player releases the ball 16, the ball 163 may roll just between each of the holes 22, 24, 26. This spacing gives the game just enough of a challenge to make it competitive but still have the games play fast. If the spacing was any wider between the holes, it would be more challenging to score, slowing down the pace of play.

The hole pattern 20 may have a pattern width C that is less than the width W of the playing surface 12. In the illustrated example, the pattern width C is approximately 13.25 inches where the width W is 15 inches. In one embodiment, the hole pattern 20 may have a pattern width C that is at least 75% of the width W. As such, the outer hole 26 may be offset from a longitudinal edge 36 of the playing surface 12 by an outer-dimension D. In the illustrated example, the outer dimension D is approximately 0.75 inches.

Each hole pattern 20 is formed of two rows 28 of holes having an outer hole 26, an intermediate hole 24 and small end hole 22. As illustrated, the two rows 28 intersect at the end hole 22 and therefore share the end hole. The rows of holes 28 are oriented at an angle E to form the V-shaped pattern 20. As illustrated, the angle E is 38 to 40 degrees. The angle E may be any angle that allows hole-spacing in the width direction so that the holes 22, 24, 26 do not overlap in the width direction. The V-shaped hole pattern 20 may have a pattern length F. In the illustrated example, the whole pattern length F is approximately 8.5 inches. The pattern length F may be less than the pattern width C. In one embodiment, the hole patterns 20 are spaced apart in the length direction by 4-7 times the pattern length F. In the illustrated example, the hole patterns are spaced apart by in a length direction by approximately 66-70 inches.

The holes in the hole pattern 20 are shown as circular holes but can be many different shapes including squares, rectangles, triangles, hexagons, or octagons, for example.

A gutter 40 surrounds the playing surface 12. The gutter 40 catches any balls 16 that roll off the playing surface 12 during a player's roll. As shown in FIGS. 1-6, the gutter 40 is defined between the walls of the shadow box 30 and the playing surface 12. In another embodiment, the gutter may be formed only along the longitudinal sides adjacent the side walls 32 of the shadow box 30. In the illustrated embodiment, the gutter 40 may have a depth of 1 inch from the playing surface 12. In another embodiment, the gutter 40 may be approximately 0.75-3 inches in depth from the playing surface 12. In the illustrated embodiment, the gutter 40 may have a width of 1.75 inches. The width of the gutter 40 may be greater than a diameter of the ball 16 to ensure the ball 16 falls into the gutter 40 and does not easily bounce off the walls 32, 34 of the shadow box 30 and remain on the playing surface 12.

The hole pattern 20 may have a plurality of pockets corresponding to each of the holes 22, 24, 26 that do not extend through the playing surface 12. The balls 16 are retrieved from the pockets after each roll and scored. Alternatively, the hole pattern 20 may have a plurality of through-slots that extend through the playing surface to a ball catch 50. The game table 10 may have a pair of ball catches 50, where one ball catch 50 is disposed below the each of the hole patterns 20.

The ball catch 50 has a plurality of channels 52 the corresponds to each of the holes 22, 24, 26 with dividers to keep balls 16 directed to the specific channel for the hole scored. Each ball catch 50 has a return opening 54. The return opening 54 is disposed outboard of the gutter and allows the players to easily retrieve and keep track of the score of the balls. The channels 52 will vary in length, width and depth depending on the size of the game table 10. Lines and Numbers The game table 10 may have lines applied to the playing surface 12 for aiding in score and playing (four at each end of the table). Two foul lines 42 extending in the width direction and are placed between the midline 46 and the hole pattern 20. The players must release the ball 16 before the foul line 42. In one embodiment, the foul lines 42 are positioned 24 inches from the back edge 38 of the playing surface 12. The score lines and numbers 48 may also be applied to the playing surface 12 to indicate the score of each hole.

The game table 10 may also include a ball holder 60 for storing the balls 16. The ball holder may include a ball rack having pockets for securely holding the balls 16. The pockets in the ball rack may be sized slightly smaller than the balls 16 so the balls fit snug in each pocket holding them securely in place even if rack is tilted at a 45-degree angle.

The playing surface 12 having the V-shaped hole pattern 20 and the gutter 40 may be scaled in size for different applications and different style games. For example, a table top version of the game table 10 may be portable to taking the game table camping, to parks, tailgates, the beach, etc. The mobile game table allows players to place the playing surface 14 on an existing table or surface. The mobile game table may be made by using a single piece of material such as wood, plastic, vinyl, PVC board, metal that forms the playing surface 12, gutters 40 and outside walls 32, 34. The gutters 40 may be routed out into this single piece of material creating the playing surface 12 in the center and walls 32, 34 defining the periphery. Holes for scoring points will remain in a "V" shape hole pattern 20. The holes 22, 24, 26 may be pockets that do not extend through the playing surface 12. The players may retrieve the balls 16 from the pockets after each roll. The mobile game table may have a ball catch with a single channel corresponding to the center end hole 22.

In another embodiment, the playing surface 12 may also be a green turf putting surface to play a golf-style game. The golf game table 10 may have a width dimension of 4-5 feet and a length dimension of 12-15 feet in length.

In another embodiment, a bowling-style game may be played with using the hole pattern 20. The playing surface may have a width dimension of 8-12 feet and a length dimension of 40-50 feet. At the end of each playing surface there will be five holes in a V-pattern that extend through the playing surface. The smallest center hole 22 may measure 8-12 inches in diameter. The intermediate holes 24 may measure 16-20 inches in diameter. The largest outer holes 26 may measure 24-30 inches in diameter. The hole spacing A between the outer hole 26 and the intermediate hole 24 may measure 2.5 feet. The hole spacing B between the intermediate hole 24 and the center end hole 22 may measure 2 feet. The balls used for the bowling style game may be 1.5 lbs-2.5 lbs and 3.5-4.5 inches in diameter. The balls may made of hard plastic, wood, or metal, and can be painted solid or given unique finishes such as marbleized, opaque, pearlescent, or even glow-in-the-dark. The playing surface may be wood with a clear high gloss finish. In another embodiment, the playing surface may be a smooth firm flexible rubber. This can allow the option of 6-12 hydraulic lifts to be placed under the rubber playing surface at symmetrical spots. Each hydraulic lift can raise from 0.5-6 inches changing the flexible rubber playing surface.

THE FOLLOWING IS A LIST OF REFERENCE NUMERALS

10—Game table
12—playing surface
14—playing ends
16—balls
18—legs
20—hole pattern
22—small center-end hole
24—intermediate holes
26—large outer holes
28—rows of holes
30—shadow box
32—side walls
34—end walls
36—longitudinal edge of playing surface
38—back edge of playing surface
40—gutter
42—foul lines
44—longitudinal centerline
46—midline
48—score lines
50—ball catch
52—ball catch scoring channels
54—ball catch opening
60—ball holder While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A game table comprising:

a generally flat and planar playing surface having opposed playing ends;

a pair of hole patterns formed adjacent each of the playing ends, each hole pattern having a plurality of holes decreasing in diameter toward the playing ends, wherein each hole pattern is formed of two rows of holes intersecting at an end hole being closest to the playing end to form a V-shaped hole pattern;

a gutter surrounding the planar playing surface along longitudinal sides edges and back edges adjacent the playing ends;

a plurality of balls each smaller than the end hole;

a pair of ball catches, one of the ball catches disposed below one of each of the hole patterns;

wherein each of the ball catches comprises a return opening disposed outboard of the gutter.

2. The game table of claim 1, wherein the opposed playing ends are spaced apart in a length dimension to allow players to participate from each of the playing ends, the length dimension greater than a width dimension of the playing surface.

3. The game table of claim 2, wherein the length dimension is a least 2.5 times the width dimension.

4. The game table of claim 2, wherein each of the plurality of holes is spaced apart in the width direction by a hole-spacing distance;

wherein the end hole is spaced apart in the width direction from intermediate holes by a second hole-spacing distance and the intermediate holes are spaced apart from outer holes by a first hole-spacing distance;

wherein the second hole-spacing distance is greater than the first hole-spacing distance.

5. The game table of claim 1, wherein the V-shaped patterns are mirror images of each other about a centerline between the playing ends.

6. The game table of claim 1, wherein the plurality of holes comprises a plurality of through-slots that extend through the playing surface.

7. The game table of claim 1, wherein the pair of hole patterns are mirror images of each other about a centerline between the opposing playing ends.

8. The game table of claim 1, wherein each hole pattern of the pair of hole patterns comprises five holes.

9. The game table of claim 1, wherein each hole pattern of the pair of hole patterns is symmetric about a longitudinal centerline of the playing surface.

10. The game table of claim 1, wherein the end hole has an end-hole diameter being smaller in diameter than each of the other holes in the rows of holes.

11. The game table of claim 1, wherein each of the ball catches comprises a plurality of channels, wherein one channel corresponds to one of the holes.

12. A game table comprising:

a generally planar and flat playing surface having opposed playing ends positioned spaced apart in a length dimension to allow players to participate from each of the playing ends, the length dimension greater than a width dimension of the playing surface;

a pair of V-shaped hole patterns oriented in the length dimension, each hole pattern formed adjacent one of the playing ends, each hole pattern having a plurality of holes extending through the playing surface, the plurality of holes decreasing in diameter toward a center-end hole positioned closest to the playing ends wherein each V-shaped hole pattern is symmetric about a longitudinal centerline of the playing surface;

at least one ball sized smaller than the center-end hole;

a gutter surrounding the playing surface along longitudinal sides edges and back edges adjacent the playing;

a pair of ball catches, one of the ball catches disposed below one of each of the hole patterns, each ball catch having a plurality of channels, wherein one channel corresponds to one of the holes;

wherein each of the ball catches comprises a return opening disposed outboard of the gutter.

13. The game table of claim 12, wherein each of the holes are spaced apart in a width direction by a hole-spacing distance less than a ball-diameter size.

14. A game table comprising:

a generally flat and planar playing surface having opposed playing ends;

a pair of hole patterns formed adjacent each of the playing ends, each hole pattern having a plurality of holes formed of two rows of holes intersecting at an end hole being closest to the playing end to form a V-shaped hole pattern, the plurality of holes decreasing in diameter toward the playing ends, wherein the end hole has an end-hole diameter being smaller than each of the other holes in the rows of holes;

a gutter surrounding the planar playing surface along longitudinal sides edges and back edges adjacent the playing ends;

a pair of ball catches, one of the ball catches disposed below one of each of the hole patterns;

wherein each of the ball catches comprises a return opening disposed outboard of the gutter.

15. The game table of claim 14, wherein each of the plurality of holes is spaced apart in a width direction by a hole-spacing distance and the opposed playing ends are spaced apart in a length dimension;

wherein the end hole is spaced apart in the width direction from intermediate holes by a second hole-spacing distance and the intermediate holes are spaced apart from outer holes by a first hole-spacing distance;

wherein the second hole-spacing distance is greater than the first hole-spacing distance.

* * * * *